US012797701B2

(12) United States Patent
Xia

(10) Patent No.: US 12,797,701 B2
(45) Date of Patent: Nov. 17, 2026

(54) PICKLEBALL PADDLE HAVING REPLACEABLE FACE SHEET

(71) Applicant: Dongguan Xinrui Technology Co., Ltd., Dongguan City (CN)

(72) Inventor: Wei Xia, Dongguan (CN)

(73) Assignee: DONGGUAN XINRUI TECHNOLOGY CO., LTD., Dongguan City (CN)

( * ) Notice: Subject to any disclaimer, the term of this patent is extended or adjusted under 35 U.S.C. 154(b) by 189 days.

(21) Appl. No.: 18/657,721

(22) Filed: May 7, 2024

(65) Prior Publication Data

US 2024/0408462 A1 Dec. 12, 2024

(30) Foreign Application Priority Data

Jun. 28, 2023 (CN) ..... 202321658022.8

(51) Int. Cl.
*A63B 59/45* (2015.01)
*A63B 102/08* (2015.01)

(52) U.S. Cl.
CPC ..... *A63B 59/45* (2015.10); *A63B 2102/08* (2015.10); *A63B 2209/02* (2013.01); *A63B 2209/10* (2013.01)

(58) Field of Classification Search
CPC ..... A63B 59/45; A63B 2102/08; A63B 59/42
See application file for complete search history.

(56) References Cited

U.S. PATENT DOCUMENTS

| | | | | |
|---|---|---|---|---|
| 2014/0066235 | A1* | 3/2014 | Hill | A63B 59/48 473/528 |
| 2016/0066717 | A1* | 3/2016 | Schneider | G06F 1/1679 5/639 |
| 2018/0104555 | A1* | 4/2018 | Taylor | A63B 59/45 |
| 2022/0266106 | A1* | 8/2022 | Nygren | A63B 59/45 |
| 2024/0181313 | A1* | 6/2024 | Bicanic | A63B 59/42 |

* cited by examiner

*Primary Examiner* — Michael D Dennis
(74) *Attorney, Agent, or Firm* — Leong C. Lei

(57) ABSTRACT

A pickleball paddle having a replaceable face sheet includes a paddle body. The paddle body has a paddle face portion, a handle portion connected to the paddle face portion, and a paddle core inside the paddle face portion. In practical applications, the user may select different face sheets with different hitting effects to be attached to two accommodation cavities of the paddle body according to his/her needs. The user may choose to replace a desired face sheet, thereby realizing the replacement of the face sheet of the pickleball paddle. This improves the flexibility of the pickleball paddle and is environmentally friendly and cost-effective.

6 Claims, 4 Drawing Sheets

PICKLEBALL PADDLE HAVING REPLACEABLE FACE SHEET

BACKGROUND OF THE INVENTION

1. Field of the Invention

The present invention relates to a pickleball paddle, and more particularly to a pickleball paddle having a replaceable face sheet.

2. Description of the Prior Art

Pickleball is a racket or paddle sport. The game was created in 1965 on Bainbridge Island, Washington. Pickleball is a hybrid sport which combines tennis, badminton and table tennis. In terms of physical activity and activity level, pickleball is easier and more enjoyable than badminton and table tennis, with greater flexibility, so it is better than badminton and table tennis in terms of physical exercise. Besides, the amount of physical activity and exercise in pickleball is less than that in tennis. For those players who are not accustomed to playing tennis and whose physical strength decreases quickly, they are suitable for playing pickleball as a regular exercise. Pickleball is suitable for a wide range of ages, about 2.5 million people in the U.S. playing the sport year-round, and has become a popular sport in middle school physical education classes.

A pickleball paddle is important to play pickleball. A pickleball paddle mainly includes a paddle face portion and a handle portion. The paddle face portion has a face sheet (rubber sheet) used for hitting a ball. In the existing pickleball paddles, the face sheet cannot be replaced. Users cannot choose different face sheets according to their needs. When the face sheet is damaged, the user has to buy a new pickleball paddle, resulting in a waste of resources as well as an increase in purchase costs.

Accordingly, the inventor of the present invention has devoted himself based on his many years of practical experiences to solve these problems and to invent a pickleball paddle having a replaceable face sheet.

SUMMARY OF THE INVENTION

The primary object of the present invention is to provide a pickleball paddle having a replaceable face sheet to overcome the deficiencies of the prior art.

In order to achieve the above object, the present invention adopts the following solutions.

A pickleball paddle having a replaceable face sheet comprises a paddle body. The paddle body has a paddle face portion, a handle portion connected to the paddle face portion, a paddle core inside the paddle face portion, an edge guard disposed along a periphery of the paddle face portion, and an accommodation cavity surrounded by two sides of the edge guard and the paddle core for positioning the face sheet.

An adhesive layer adhered to a surface of the paddle core and a release layer adhered to a surface of the adhesive layer are disposed in the accommodation cavity. After the release layer is peeled off, the face sheet is adhered to the adhesive layer.

Preferably, an inner wall of the edge guard, corresponding to the accommodation cavity, has an inclined guide portion and a vertical portion connected to the inclined guide portion. The inclined guide portion extends obliquely to the vertical portion. The adhesive layer and the release layer are located within a range enclosed by the vertical portion.

Preferably, a positioning edge is disposed at a junction of the handle portion and the paddle face portion. One end of the edge guard, corresponding to the positioning edge, has an opening. The opening has a width greater than a length of the positioning edge. The positioning edge is spaced from the edge guard at the position of the opening to form a hand tear region for acting on the face sheet and the release layer.

Preferably, the adhesive layer has a thickness of 30-300 μm.

Preferably, the adhesive layer is one of a room-temperature hardening adhesive layer, a hot-melt adhesive layer and a self-adhesive layer.

Preferably, the paddle core is made of one of a PP (polypropylene) honeycomb material, a paper honeycomb material, an aluminum honeycomb material, an EVA (ethylene vinyl acetate) material, a carbon fiber material, and a PVC (polyvinyl chloride) honeycomb material.

Preferably, the release layer is one of a release paper layer, a release film layer and a release fabric layer.

Preferably, the edge guard is made of a carbon fiber material or a glass fiber material.

Compared with the prior art, the beneficial effects of the present invention are as follows:

The edge guard is disposed along the periphery of the paddle face portion, and the accommodation cavity are surrounded by the two sides of the edge guard and the paddle core for positioning the face sheet, thereby improving the attachment of the face sheet to the paddle core. On this basis, the adhesive layer and the release layer are sequentially adhered to the accommodation cavity. In practical applications, the user may select different face sheets with different hitting effects to be attached to the two accommodation cavities according to his/her needs. For example, depending on the structural characteristics of the face sheets, such as strength, elasticity, hardness, friction, or sound, two different face sheets can produce different hitting effects. The user may choose different face sheets that have differences in the feel or sound of hitting a ball, improving the user experience as well as increasing the fun effectively. In the attachment process of the face sheet, it is only necessary to peel off the release layer from the adhesive layer, and then the face sheet is adhered to the accommodation cavity. The overall operation is simple.

The adhesive layer may be a reusable adhesive layer. For example, the adhesive layer may be one of a hot-melt adhesive layer and a self-adhesive layer. Within a certain number of times, the user may choose to replace a desired face sheet, thereby realizing the replacement of the face sheet of the pickleball paddle. This improves the flexibility of the pickleball paddle and is environmentally friendly and cost-effective.

Additional aspects and advantages of the present invention are set forth, in part, in the following description, become obvious from the following description, or may be learned through the practice of the present invention.

BRIEF DESCRIPTION OF THE DRAWINGS

In order to clearly illustrate the embodiments of the present invention or the technical solutions in the existing technology, the following drawings, which are used in the description, are briefly described. The accompanying drawings in the following description are merely illustrative embodiments of the present invention. For those skilled in the art, the drawings of other embodiments may be obtained according to the accompanying drawings under the premise of not paying creative work.

DETAILED DESCRIPTION OF THE PREFERRED EMBODIMENTS

Embodiments of the present invention will now be described, by way of example only, with reference to the accompanying drawings. Advantages and features of the inventive concept and methods of accomplishing the same may be understood more readily by reference to the following detailed description of embodiments and the accompanying drawings. The present inventive concept may, however, be embodied in many different forms and should not be construed as being limited to the embodiments set forth herein.

Figure 1:
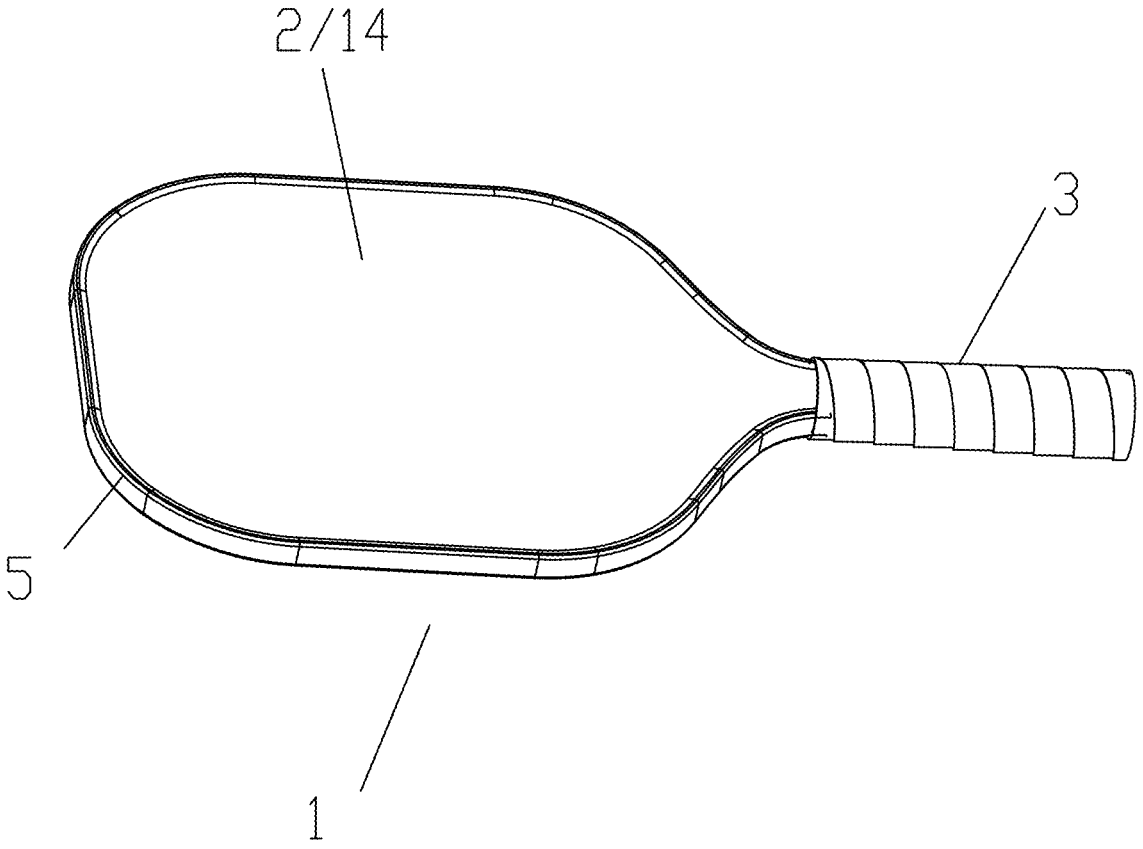
FIG. 1 is a perspective view of the present invention.
Figure 2:
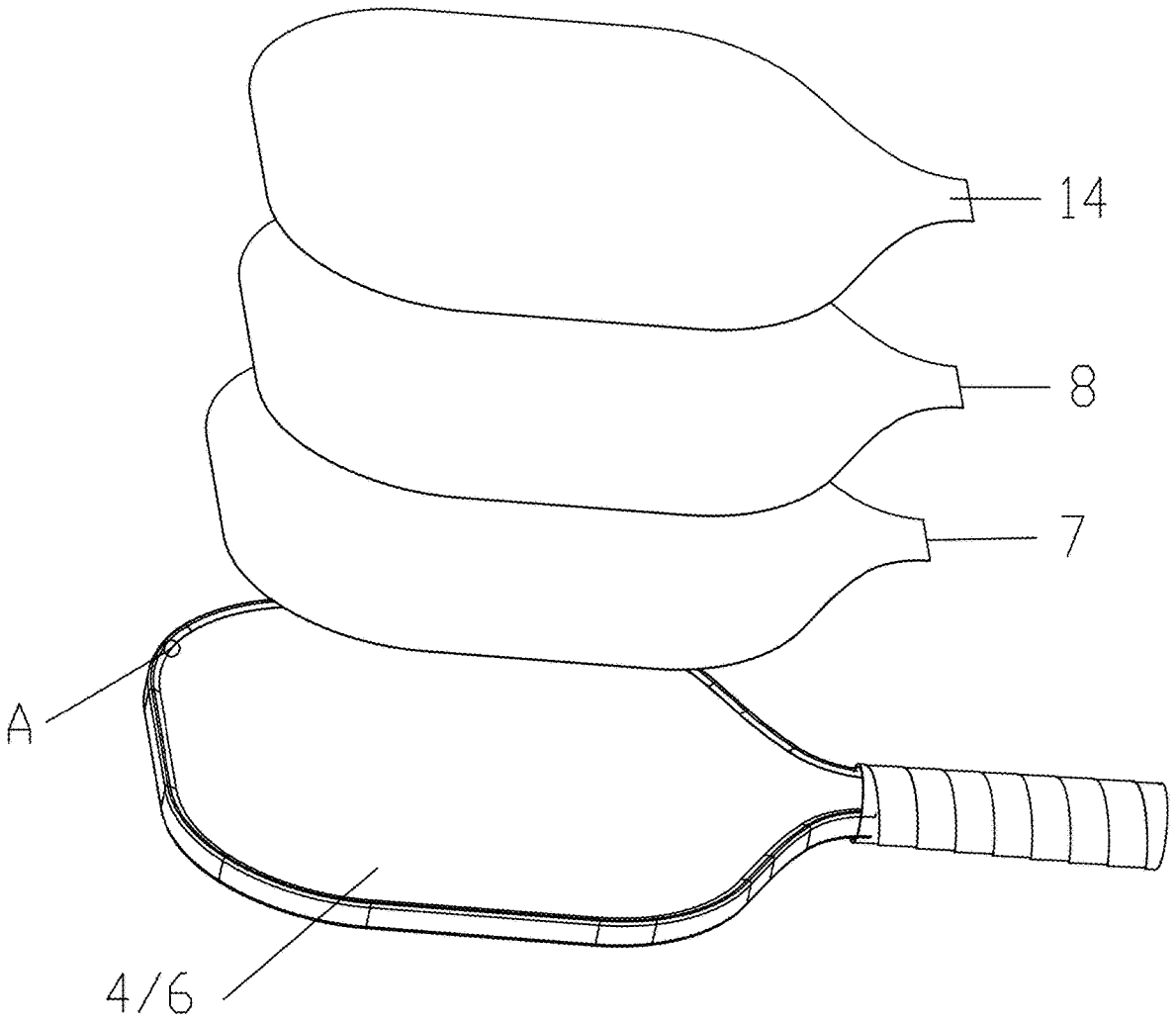
FIG. 2 is an exploded view of the present invention.
Figure 3:
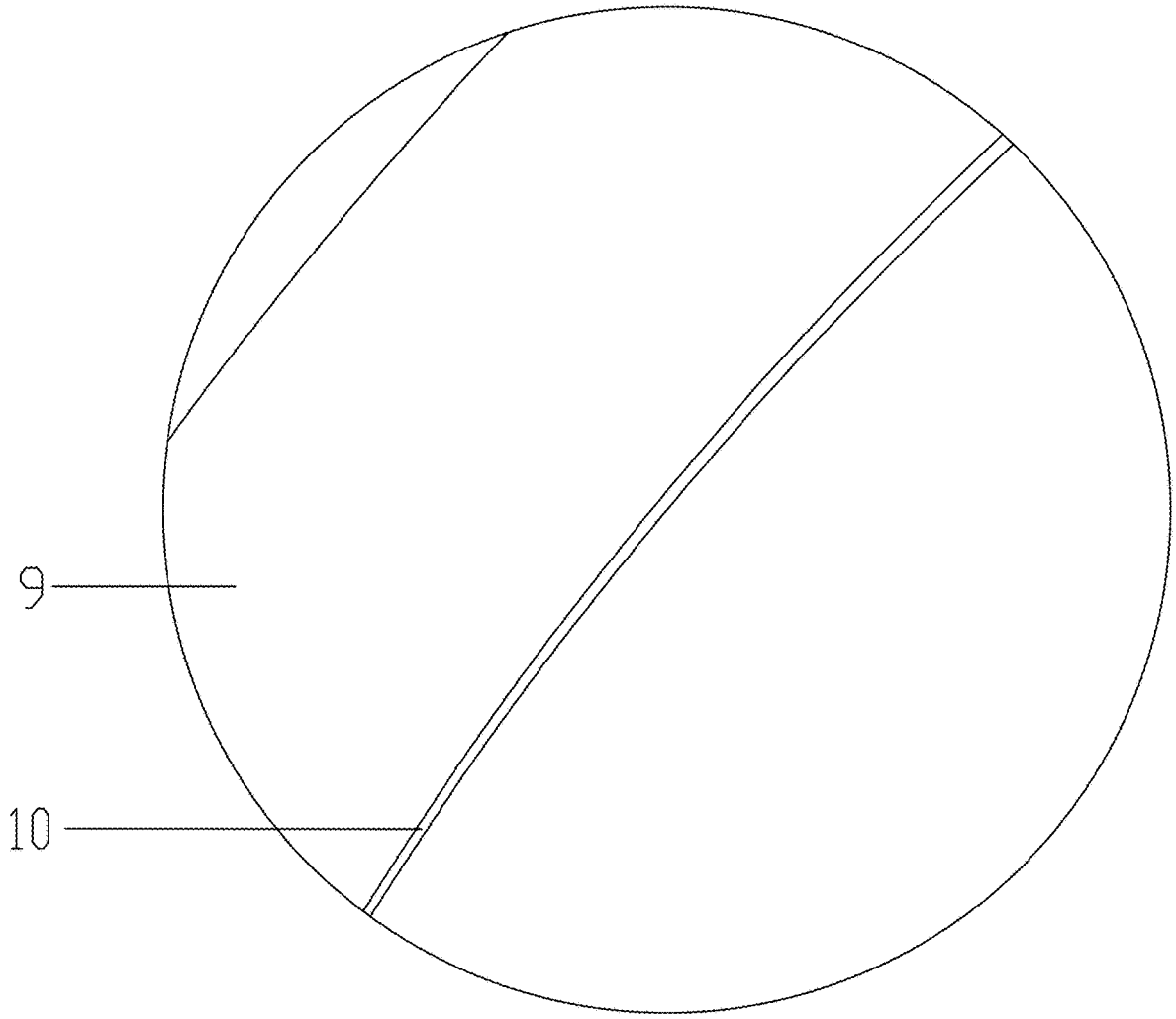
FIG. 3 is an enlarged view of circle A of FIG. 2.
Figure 4:
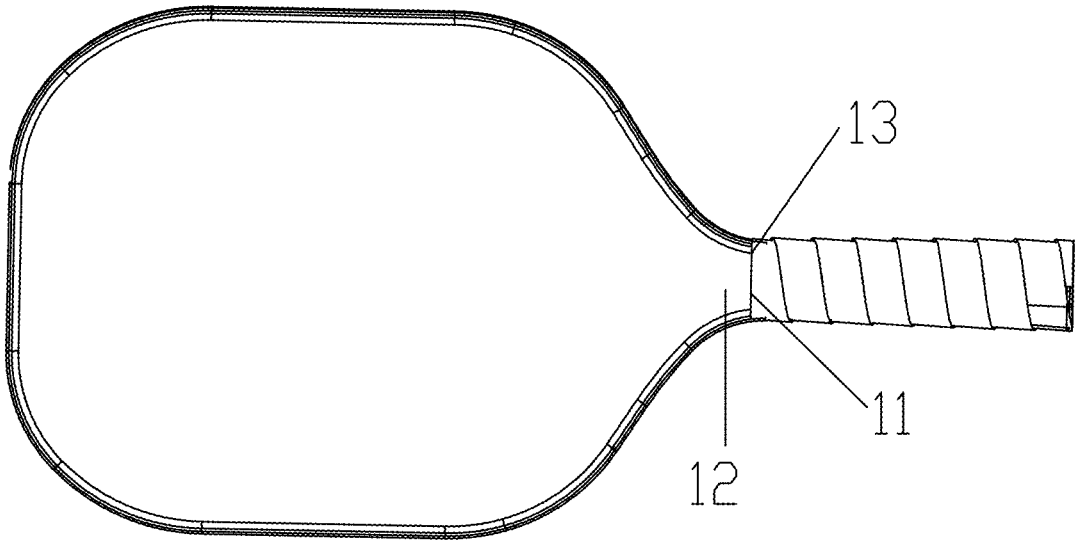
FIG. 4 is a cross-sectional view of the present invention.

Referring to FIG. 1 through FIG. 4, the present invention discloses a pickleball paddle having a replaceable face sheet 14. The pickleball paddle comprises a paddle body 1. The paddle body 1 has a paddle face portion 2, a handle portion 3 connected to the paddle face portion 2, a paddle core 4 inside the paddle face portion 2, an edge guard 5 disposed along the periphery of the paddle face portion 2, and an accommodation cavity 6 surrounded by two sides of the edge guard 5 and the paddle core 4 for positioning the face sheet 14.

An adhesive layer 7 adhered to the surface of the paddle core 4 and a release layer 8 adhered to the surface of the adhesive layer 7 are disposed in the accommodation cavity 6. After the release layer 8 is peeled off, the face sheet 14 is adhered to the adhesive layer 7.

In the technical solution of the present invention, the edge guard 5 is disposed along the periphery of the paddle face portion 2, and the accommodation cavity 6 are surrounded by the two sides of the edge guard 5 and the paddle core 4 for positioning the face sheet 14, thereby improving the attachment of the face sheet 14 to the paddle core 4. On this basis, the adhesive layer 7 and the release layer 8 are sequentially adhered to the accommodation cavity 6. In practical applications, the user may select different face sheets 14 with different hitting effects to be attached to two accommodation cavities 6 according to his/her needs. For example, depending on the structural characteristics of the face sheets 14, such as strength, elasticity, hardness, friction, or sound, two different face sheets 14 can produce different hitting effects. The user may choose different face sheets 14 that have differences in the feel or sound of hitting a ball, improving the user experience as well as increasing the fun effectively. In the attachment process of the face sheet 14, it is only necessary to peel off the release layer 8 from the adhesive layer 7, and then the face sheet 14 is adhered to the accommodation cavity 6. The overall operation is simple.

Preferably, the adhesive layer 7 may be a reusable adhesive layer. For example, the adhesive layer 7 may be one of a hot-melt adhesive layer and a self-adhesive layer.

When the adhesive layer 7 is a hot melt adhesive layer, the user may heat the hot melt adhesive on the paddle face portion 2 to a certain temperature, peel off the release layer 8, smooth the hot melt adhesive on the paddle face portion 2, select a desired face sheet 14, and attach the face sheet 14 to the accommodation cavity 6. After cooling, the face sheet 14 is adhered to the adhesive layer 7. Similarly, when the face sheet 14 is damaged, the face sheet 14 will be replaced with a new one as described above.

When the adhesive layer 7 is a self-adhesive layer, the user may directly peel off the release layer 8 from the adhesive layer 7 and then attach the face sheet 14 to the accommodation cavity 6. Similarly, when the face sheet 14 is damaged, the damaged face sheet 14 will be replaced with a new one.

Within a certain number of times, the user may choose to replace a desired face sheet 14, thereby realizing the replacement of the face sheet 14 of the pickleball paddle. This improves the flexibility of the pickleball paddle and is environmentally friendly and cost-effective.

In one embodiment, the adhesive layer 7 may be a room-temperature hardening adhesive layer, so as to achieve a one-time attachment of the face sheet 14. Compared with the above case that the adhesive layer 7 is one of a hot-melt adhesive layer and a self-adhesive layer, the adhesive layer 7 in the form of a room-temperature hardening adhesive is only suitable for a one-time attachment of the face sheet 14 when the release layer 8 is peeled off. The replacement of the face sheet 14 is not possible.

In the embodiment of the present invention, the inner wall of the edge guard 5, corresponding to the accommodation cavity 6, has an inclined guide portion 9 and a vertical portion 10 connected to the inclined guide portion 9. The inclined guide portion 9 extends obliquely to the vertical portion 10. Both the adhesive layer 7 and the release layer 8 are located within the range enclosed by the vertical portion 10.

Through the arrangement of the inclined guide portion 9 and the vertical portion 10, the inclined guide portion 9 plays a guide role for the face sheet 14 to be placed in the accommodation cavity 6, and the vertical portion 10 is configured for confining the face sheet 14 accurately. The combination of the inclined guide portion 9 and the vertical portion 10 effectively improves the attachment of the face sheet 14 to the paddle core 4 and makes the operation of attachment simpler.

In the embodiment of the present invention, a positioning edge 11 is disposed at the junction of the handle portion 3 and the paddle face portion 2. One end of the edge guard 5, corresponding to the positioning edge 11, has an opening 12. The width of the opening 12 is greater than the length of the positioning edge 11. The positioning edge 11 is spaced from the edge guard 5 at the position of the opening 12 to form a hand tear region 13 for acting on the face sheet 14 and the release layer 8.

Through the arrangement of the positioning edge 11, in the attachment process of the face sheet 14, first, one end of the face sheet 14, corresponding to the handle portion 3, leans against the positioning edge 11. Then, the face sheet 14 is attached to the accommodation cavity along the inner wall of the vertical portion 10. This ensures the attachment of the face sheet 14 to the paddle core 4 and simplifies the action of attachment. Through the arrangement of the hand tear region 13, it is convenient to tear off the release layer 8 or the damaged face sheet 14 without damaging the paddle core 4. It can be understood that one end of the handle portion 3 has a clearance space at the positioning edge 11 to facilitate the user to tear off the release layer 8 or the damaged face sheet 14.

In the embodiment of the present invention, the thickness of the adhesive layer 7 is 30-300 μm.

In the embodiment of the present invention, the material of the paddle core 4 may be any one of a PP (polypropylene) honeycomb material, a paper honeycomb material, an aluminum honeycomb material, an EVA (ethylene vinyl acetate) material, a carbon fiber material and a PVC (polyvinyl chloride) honeycomb material, but not limited thereto.

In the embodiment of the present invention, the release layer 8 is any one of a release paper layer, a release film layer and a release fabric layer, but not limited thereto.

In the embodiment of the present invention, the edge guard 5 is made of a carbon fiber material or a glass fiber material.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pickleball paddle having a replaceable face sheet, comprising a paddle body, the paddle body having a paddle face portion, a handle portion connected to the paddle face portion, a paddle core inside the paddle face portion, an edge guard disposed along a periphery of the paddle face portion, and an accommodation cavity surrounded by two sides of the edge guard and the paddle core for positioning the face sheet;

wherein an adhesive layer adhered to a surface of the paddle core and a release layer adhered to a surface of the adhesive layer are disposed in the accommodation cavity, after the release layer is peeled off, the face sheet is adhered to the adhesive layer;

wherein an inner wall of the edge guard, corresponding to the accommodation cavity, has an inclined guide portion and a vertical portion connected to the inclined guide portion, the inclined guide portion extends obliquely to the vertical portion, and the adhesive layer and the release layer are located within a range enclosed by the vertical portion.

2. The pickleball paddle as claimed in claim 1, wherein the adhesive layer has a thickness of 30-300 μm.

3. The pickleball paddle as claimed in claim 1, wherein the adhesive layer is one of a room-temperature hardening adhesive layer, a hot-melt adhesive layer and a self-adhesive layer.

4. The pickleball paddle as claimed in claim 1, wherein the paddle core is made of one of a PP (polypropylene) honeycomb material, a paper honeycomb material, an aluminum honeycomb material, an EVA (ethylene vinyl acetate) material, a carbon fiber material and a PVC (polyvinyl chloride) honeycomb material.

5. The pickleball paddle as claimed in claim 1, wherein the release layer is one of a release paper layer, a release film layer and a release fabric layer.

6. The pickleball paddle as claimed in claim 1, wherein the edge guard is made of a carbon fiber material or a glass fiber material.

* * * * *